US008217318B1

(12) United States Patent
Wood-Putnam et al.

(10) Patent No.: US 8,217,318 B1
(45) Date of Patent: Jul. 10, 2012

(54) SUBMERSIBLE HAND WARMER

(75) Inventors: Jody Wood-Putnam, Panama City, FL (US); Marshall L Nuckols, Panama City, FL (US); Kenneth Price, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 451 days.

(21) Appl. No.: 12/653,415

(22) Filed: Dec. 4, 2009

(51) Int. Cl.
*H05B 1/00* (2006.01)

(52) U.S. Cl. ..... 219/482; 219/211; 219/527; 219/529

(58) Field of Classification Search ..... 219/211, 219/227, 228, 229, 527, 529, 531, 534
See application file for complete search history.

(56) References Cited

U.S. PATENT DOCUMENTS

| | | | | |
|---|---|---|---|---|
| 3,569,666 | A * | 3/1971 | Murphy et al. | 219/211 |
| 3,869,594 | A * | 3/1975 | Shively | 219/211 |
| 4,107,509 | A * | 8/1978 | Scher et al. | 607/108 |
| 5,160,828 | A * | 11/1992 | Olsen | 219/211 |

* cited by examiner

*Primary Examiner* — Tan T. Nguyen
(74) *Attorney, Agent, or Firm* — James T. Shepherd

(57) ABSTRACT

The invention is a submersible hand warmer apparatus for warming a diver's gloved hands. The apparatus includes a sleeve having a center portion with an elongate chamber with a right access port and a left access port; and right and left sleeve portions with elastic cuffs. The cuffs can be stretched allowing the diver's gloved hands access to the chamber, and then retract, forming a seal against the diver's arms. The chamber is sized for enough heat transfer fluid, such as water, so that the temperature of the diver's hands is raised to at least 54° F. upon immersion of his hands in the water. The apparatus also includes a heating component; an energy source, such as a battery; a housing which provides structural support; an insulation that slows the loss of heat to the cold ambient water; and a controller that controls the rate that energy is consumed.

20 Claims, 7 Drawing Sheets

SUBMERSIBLE HAND WARMER

STATEMENT OF GOVERNMENT INTEREST

The invention described herein may be manufactured and used by or for the Government of the United States of America for Governmental purposes without the payment of any royalties thereon or therefore.

BACKGROUND OF THE INVENTION

1. Field of the Invention

The present invention relates generally to scuba diving equipment, and in particular to a submersible hand warmer, which is an apparatus that improves a diver's manual dexterity in underwater operations in frigid water.

2. Prior Art

Dry Suits, such as the variable volume dry suit (VVDS) have proven to be effective in keeping divers warm in near-freezing water. It is typically constructed of ¼-inch closed-cell neoprene with nylon backing on both sides. Boots are provided as an integral part of the suit, but the hood and three finger gloves are usually separate. The suit is entered by means of a water- and pressure-proof zipper. Inflation is controlled using inlet and outlet valves which are fitted into the suit. Air is supplied from a pressure reducer on an auxiliary cylinder or from the emergency gas supply or the scuba bottle. About 0.2 actual cubic foot of air is required for normal inflation. Because of this inflation, slightly more weight than would be used with a wet suit must be carried. Normally, thermal underwear is worn under the suit for insulation.

Gloves are an essential item of protective clothing. They can be made of leather, cloth, or rubber, depending upon the degree and type of protection required. Gloves shield the hands from cuts and chafing, and provide protection from cold water. Some styles are designed to have insulating properties but they limit the diver's dexterity. Wet or dry suits can be worn with hoods, gloves, boots, or hard-soled shoes depending upon conditions. If the diver will be working under conditions where the suit may be easily torn or punctured, the diver should be provided with additional protection such as coveralls or heavy canvas chafing gear.

While dry suits protect a diver's torso, arms, and legs in cold water diving, they don't provide adequate thermal protection for the diver's hands. A diver's hands are the first to be impacted during exposures in frigid water. Inevitably, the diver's ability to perform meaningful work is greatly reduced during the exposure to cold as the diver's tactile sensitivity diminishes.

An apparatus that enables a diver to warm his hands, therein restoring manual dexterity and preventing tissue damage would be very useful to the diver, both psychologically and physiologically.

SUMMARY OF THE INVENTION

The invention provides for a submersible hand warmer, which is an apparatus that enables a diver to warm his hands and gloves periodically during the dive. The submersible hand warmer has a sleeve covered chamber with a right access port and a left access port. The chamber contains a heat transfer fluid, usually water, that is relatively warmer than the cold ambient water, and the diver's hands and gloves are immersed in the warmer fluid when the diver positions them in the chamber. The diver's hands and gloves come into contact with other elements of the submersible hand warmer, but the heat transfer fluid provides almost all of the heat to the diver. The heat transfer fluid is substantially water, which is safe, effective as it has a high heat capacity, and it is readily available.

An aspect of the invention is that the submersible hand warmer has a sleeve with a center sleeve portion, a right sleeve portion with a right cuff and a left sleeve portion with a left cuff, where both the right cuff and the left cuff are elastic. The cuffs can stretch circumferentially to allow for the driver's hands and gloves to slide through the cuffs into the chamber through the access ports. The right cuff retracts forming a right seal between the diver's right arm and the right cuff, which serves to retain the warm water in the chamber. Likewise, the left cuff retracts forming a left seal between the diver's left arm and the left cuff.

Another aspect of the invention is that the submersible hand warmer has an insulation which insulates the chamber, a heating component that warms the water, and an energy source that provides the energy for the heating component. The submersible hand warmer is substantially adiabatic in that not only is the heat from the heating component captured, but also any incidental heat generated by the energy source is captured. For example, a battery generates a finite amount of incidental heat in the course of generating an electrical current. In most systems this incidental heat is dissipated. In the instant invention the heat is captured, therein improving the efficiency of the apparatus, approaching a system that is substantially adiabatic. The incidental heat and heat from the heating component warm the water in the chamber. The resulting warm heat transfer fluid is ultimately used to warm the diver's hands when they are immersed in the warm water. Upon warming the diver regains his manual dexterity.

Another aspect of the invention is that the chamber has a volume to hold a sufficient amount of water to warm the diver's hands and gloves to a temperature that is warm enough to provide immediate relief from the very cold ambient water. A target temperature for the warm water is at least about 54° F., so as to avoid tissue damage during long exposures-non-freezing cold injury of the extremities, which can occur during cold water exposures below 54° F. (12° C.). A further aspect of the invention is that the volume is not so large as to require a wasteful amount of energy. Prior to use in the frigid water the submersible hand warmer can be pre-warmed utilizing an external energy source to warm the water in the chamber. Pre-warming eliminates any delay caused by starting the heating with frigid water, pre-warming warms all the elements of the submersible hand warmer, and pre-warming augments the energy source.

BRIEF DESCRIPTION OF THE DRAWINGS

The foregoing invention will become readily apparent by referring to the following detailed description and the appended drawings in which.

DETAILED DESCRIPTION OF THE INVENTION

The invention provides for a submersible hand warmer, which is an apparatus that enables a diver to warm his hands and gloves while underwater. The hand warmer is portable, and can be easily carried by the diver.

Figure 1:
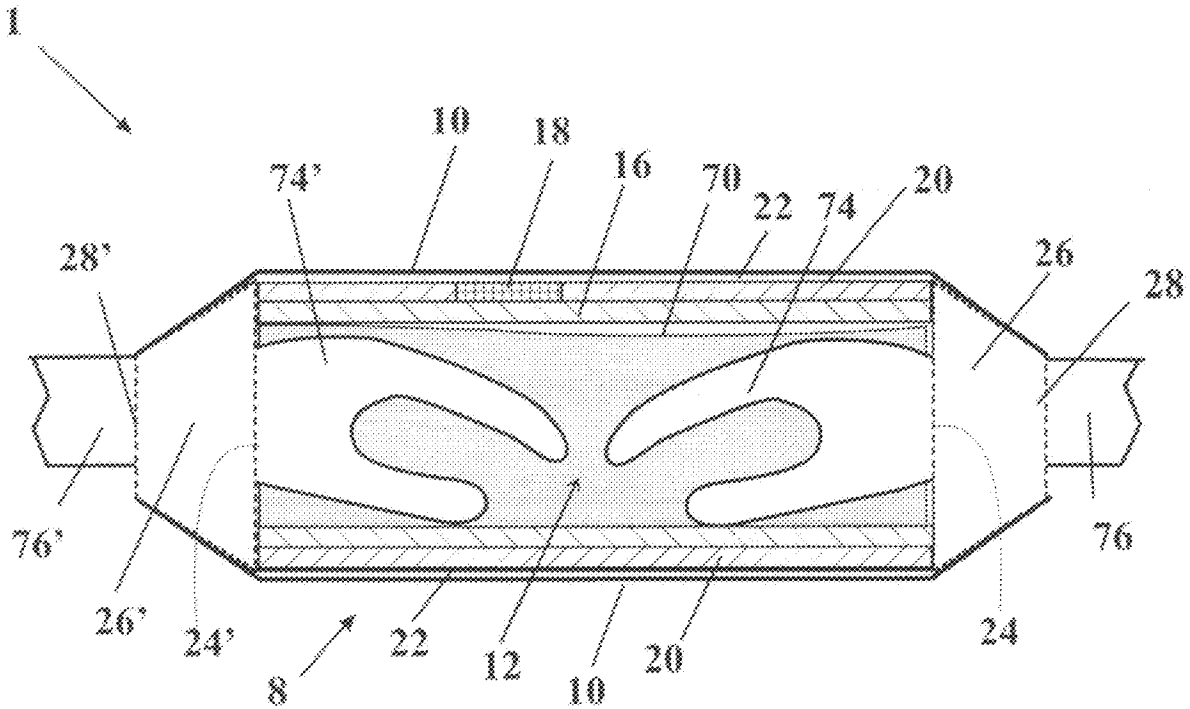
FIG. 1 is a diagrammatic cutaway approximately side view of a version of a submersible hand warmer from a diver's perspective illustrating some of the aspects of the invention, including the placement of the diver's gloved hands in the chamber of the submersible hand warmer, such that his hands and gloves are immersed in the warming heat transfer fluid, which typically is warm water.
Figure 2:
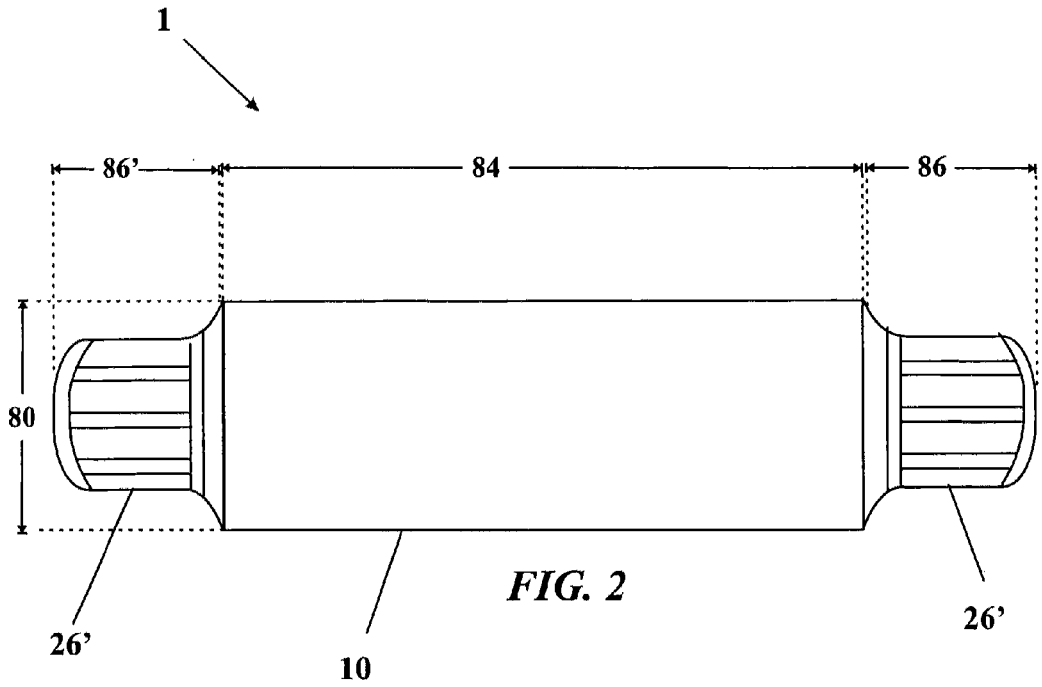
FIG. 2 is an overhead side view of the submersible hand warmer having an elongate elliptical housing.
Figure 3:
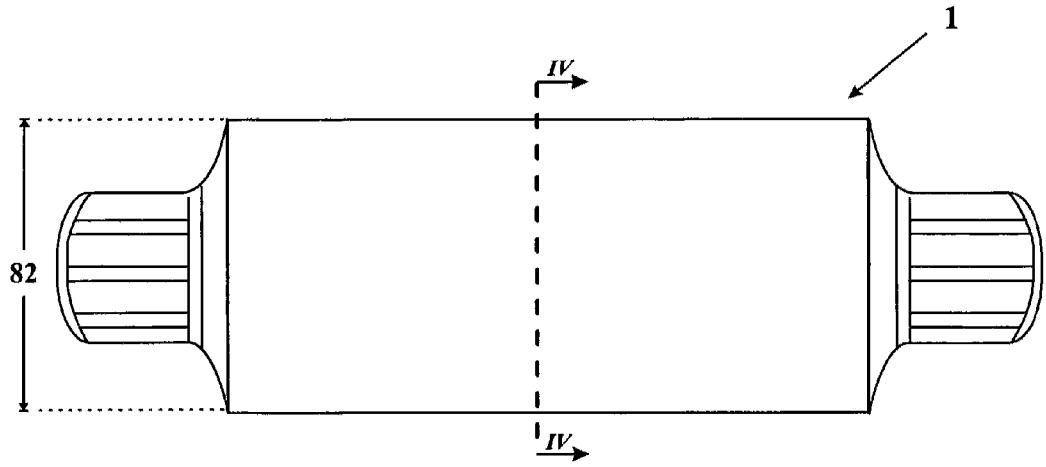
FIG. 3 is a frontal side view of the submersible hand warmer illustrated in FIG. 2.
Figure 4:
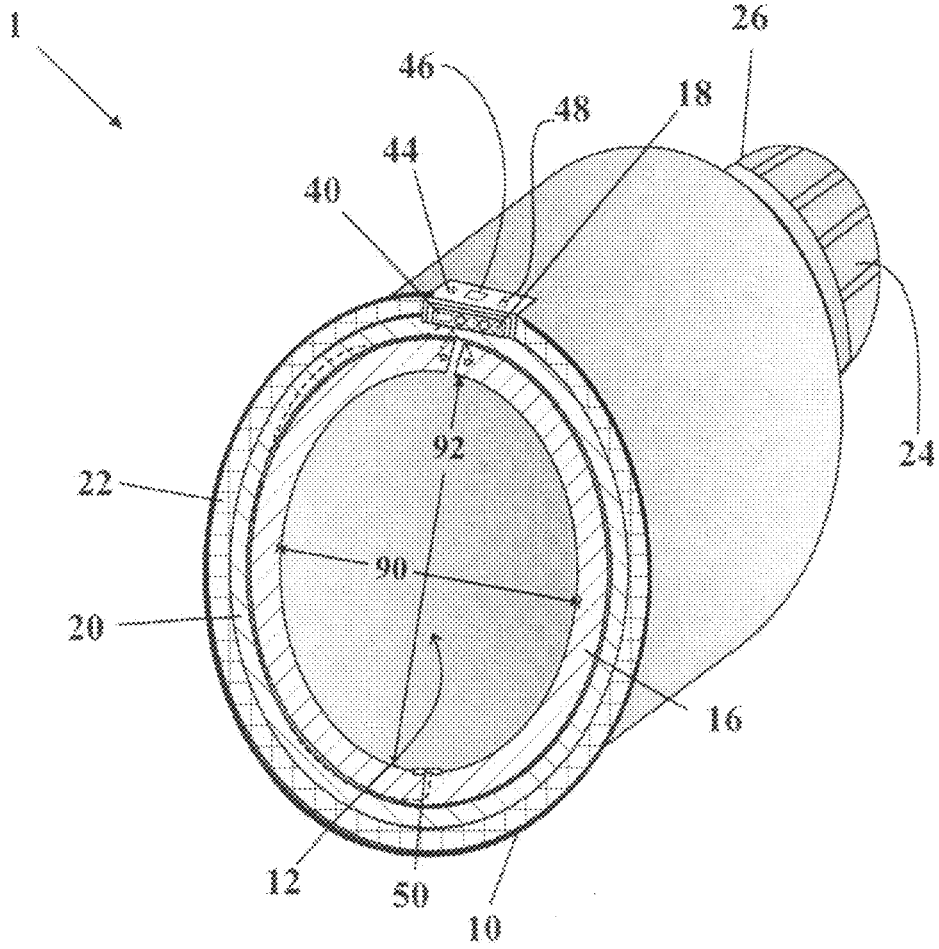
FIG. 4 is a cross sectional view of the submersible hand warmer illustrated in FIG. 3 taken along sectional line IV-IV.

FIG. 1 is a diagrammatic cutaway side view of a version of a submersible hand warmer 1 that illustrates some of the aspects of the invention, including the placement of the diver's gloved hands 74'(left),74(right) in the chamber 12 of the apparatus, such that his hands and gloves are immersed in the warming heat transfer fluid 70, warm water. As shown in the drawing the water line 70 substantially completely fills the chamber 12. The submersible hand warmer 1 has a sleeve 8 with a center sleeve portion 10, a right sleeve portion 26 and a left sleeve portion 26'. The chamber 12 is elongate, and it has a right access port 24 and a left access port 24' (indicated by dashed lines). The chamber is sized to accommodate an effective amount of a heat transfer fluid, where an effective amount is the amount that raises the temperature of the diver's hands to at least 54° F. (12° C.) upon immersion of his hands in the heat transfer fluid. As is illustrated the chamber has a length that is long enough to accommodate a pair of gloved hands. In FIGS. 2,3,4 the preferred chamber is substantially elliptical in circumference, having a long diameter and a short diameter, where the long diameter is longer than a width of a gloved hand and the short diameter is wider than a thickness of a gloved hand. For an adult male, a nominally effective amount of heat transfer fluid (e.g., water) in chamber 12 is about one liter plus or minus one half of a liter.

The right sleeve portion 26 extends from the right access port 24 with a right elastic cuff 28, and the left sleeve portion 26' extends from the left access port 24' with a left elastic cuff 28'. Both cuffs can stretch allowing the diver's gloved hands access to the chamber 12. After the diver has moved his gloved hands into the chamber the cuffs retract, forming at least a partial seal against the diver's right arm and left arm 76,76'.

There is a heating component 16 which is in contact with the heat transfer fluid 70, and the heating component 16 warms the heat transfer fluid to at least 54° F. There is an energy source 18 that can provide sufficient energy to the heating component 16 to heat the heat transfer fluid to at least 54° F. in a matter of minutes.

The submersible hand warmer apparatus 1 typically includes a housing 20 which provides structural support for the apparatus, and a layer of insulation 22 (which can be a part of the sleeve 8) that slows the loss of heat to cold ambient water, and a controller 40 (not shown in this figure) that controls the rate of energy used by the heating component. The rate that energy is consumed is a factor that is determinative of the temperature of the heat transfer fluid.

Figure 8:
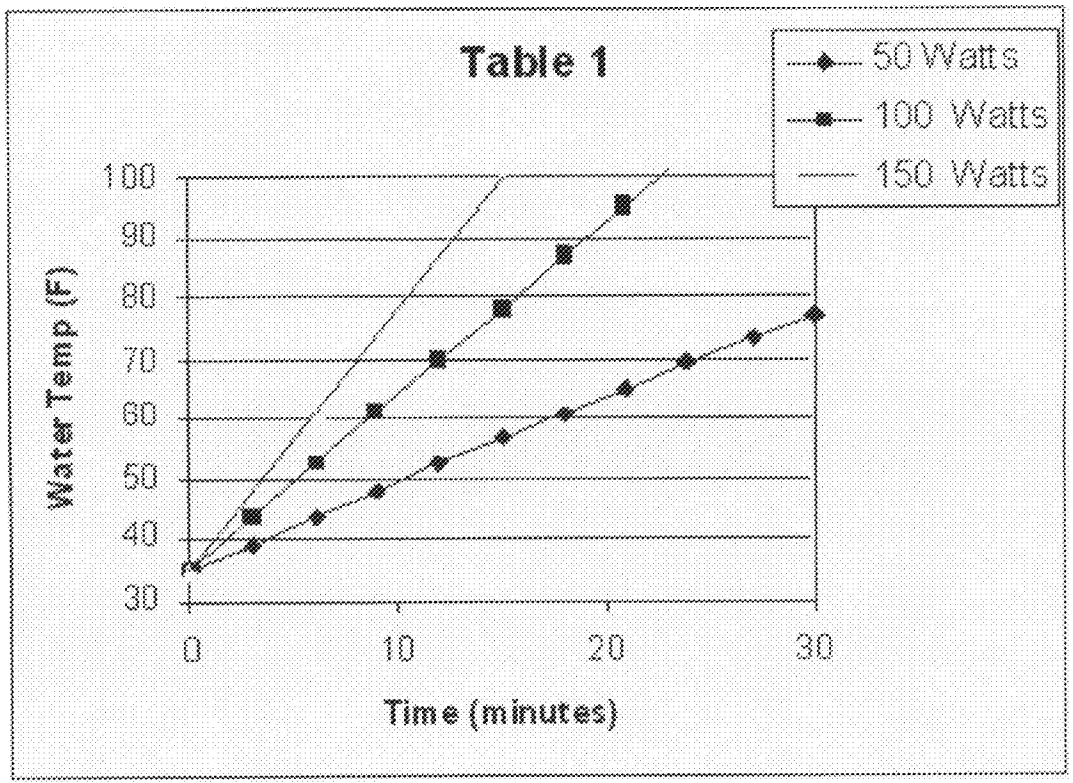
FIG. 8 as shown in Table 1 illustrates the time temperature to heat water at various wattages.

Table 1 shown in FIG. 8 illustrates the time temperature relationship at various wattages to heat 0.85 liters of water. The water temperature can be elevated from 35° F. to 60° F. in as little as 6 minutes with a 150 watt heater, 8-9 minutes with a 100 watt heater, and 18 minutes with a 50 watt heater. The heating response is shortened as the energy, in this example—wattage, is increased or the volume of water in the chamber is reduced. If allowed to continue, the water temperature inside the hand warmer would continue to rise to potentially unsafe temperatures unless cold ambient water is allowed to enter, for instance, by the diver removing his hands from the hand warmer or by employing a feedback controller that reduces the heat at a set-point.

FIG. 2 is an overhead side view of the submersible hand warmer having an elongate elliptical housing. The elliptical housing reduces the volume in the chamber while still enabling someone with the same size gloved hand to fit into the chamber. The elliptical housing could be fabricated inexpensively by flattening a plastic pipe, such as PVC pipe. PVC is thermoplastic, and can be permanently deformed when heated. In one embodiment the elliptical housing is fabricated using a 4-inch diameter PVC pipe that was heated in an oven to 350° F., and then pressed to flatten the round pipe into an elliptical shape. The flattened shape reduces the volume of the chamber 12. The short diameter of the elliptical housing is given by line 80.

The right end of the elliptical pipe serves as a right access port to the chamber, and the left end of the pipe serves as a left access port to the chamber. The elliptical housing is covered with the sleeve 8 forming the apparatus 1 illustrated in FIG. 2. Sleeve 8 has a center portion 10 covering the housing (flattened pipe); a right sleeve portion 26 extending from the right access port with a right elastic cuff 28; and a left sleeve portion extending from the left access port with a left elastic cuff 28'. The overall outside length of the sleeve 8 is the sum of lines 86'+84+86. The right elastic cuff 28 and the left elastic cuff 28' can stretch allowing the diver's gloved hands access to the chamber.

FIG. 3 is a frontal side view that illustrates the longer diameter 82 of the elliptical housing. The sleeve 8 is made of an elastic insulating material, such as neoprene, silicone rubber and the like, where scuba diving elastomeric materials have been found to be particularly suitable.

FIG. 4 is a cross sectional view of the submersible hand warmer illustrated in FIG. 3 taken along sectional line IV-IV. An inside diameter of the housing 20 has a heating component 16 which is in contact with the heat transfer fluid and warms the heat transfer fluid to at least 54°. The illustrated heating component is a rubbery heating pad. The pad in one version employs a silicone rubber, and is selected to provide a heater with the desired energy range. From Table 1, a suitable energy range is from about 40 watts to about 175 watts. Mimco, Inc of Minneapolis, Minn. makes a variety of silicone rubber heating pads, and in one variation a 48 watt pad was used. The pad reduces the useable space in the chamber 12. A pad that covers the inside surface of the chamber has a smaller volume for the heat transfer fluid. The surface padded ellipse has a short diameter as indicated by line 90 that has a length that is greater than a thickness of the diver's gloved hand, and a long diameter as indicated by line 92 that is greater than a width of the diver's gloved hand.

The energy source 18 for the illustrated submersible hand warmer is a battery pack. Typically, the batteries are rechargeable. The energy source is selected in part because it must be able to function properly in a pressurized underwater environment. A battery may also be selected for tactical considerations, for instance how well it will store for long periods. A brief discussion of different batteries follows. Nickel Cadmium (NiCd)—mature and well understood but relatively low in energy density. NiCd is used where long life, high discharge rate and economical price are important. Nickel-Metal Hydride (NiMH)—has a higher energy density compared to the NiCd at the expense of reduced cycle life. NiMH contains no toxic metals. Lead Acid—most economical for larger power applications where weight is of little concern. Lithium Ion (Li-ion)—fastest growing battery system. Li-ion has high-energy density and light weight. Reusable Alkaline—suitable for low-power applications, and limited cycle life. On the plus side they have low self-discharge, making this battery ideal for long storage applications. The selection of the appropriate battery for a specific application is well within the capabilities of one skilled in the art.

The housing is covered with a layer of insulation 22. The insulation may be built into the center sleeve 10. The illustrated version has a controller 40 that controls the rate of energy received by the heating component 16, and therein controls the temperature of the heat transfer fluid. The controller can be a feedback controller, such as an On/Off Controller (controller switches On/Off only when the temperature of the heat transfer fluid as measured by said temperature sensor crosses a setpoint), a Proportional Controller (controller decreases the average power supplied to the heater as the temperature of the heat transfer fluid approaches the setpoint), a PID controller (provides proportional with integral and derivative control—sometimes referred to as autotune controllers), and other feedback controllers. The illustrated feedback controller 40 compares the temperature detected by the thermal sensor 50 with the setpoint, and adjusts the energy (current) appropriately. The setpoint is the desired value in a closed-loop feedback system. In the illustrated embodiment the thermal sensor 50 is located at the bottom of the chamber 12, where water would normally come into contact with the sensor first. The thermal sensor 50 includes thermocouples, thermistors, and the like.

The controller 40 is in electrical communication with a recharging jack 44. The recharging jack 44 enables the use of an external power source to recharge the batteries and to pre-condition (warm) the submersible hand warmer and the water in the chamber. Prior to use in frigid water, the submersible hand warmer would be pre-warmed utilizing an external energy source. Pre-warming eliminates any delay caused by starting the heating with frigid water. Pre-warming warms all the elements of the submersible hand warmer apparatus, and pre-warming supplements the energy source. The submersible hand warmer apparatus may also have an illuminated display 46 that provides a calculated estimate of a remaining operational percentage of energy or time, a projection based on the rate that energy is being consumed. The submersible hand warmer apparatus also has an on/off switch 48 to activate or end heating.

Figure 5:
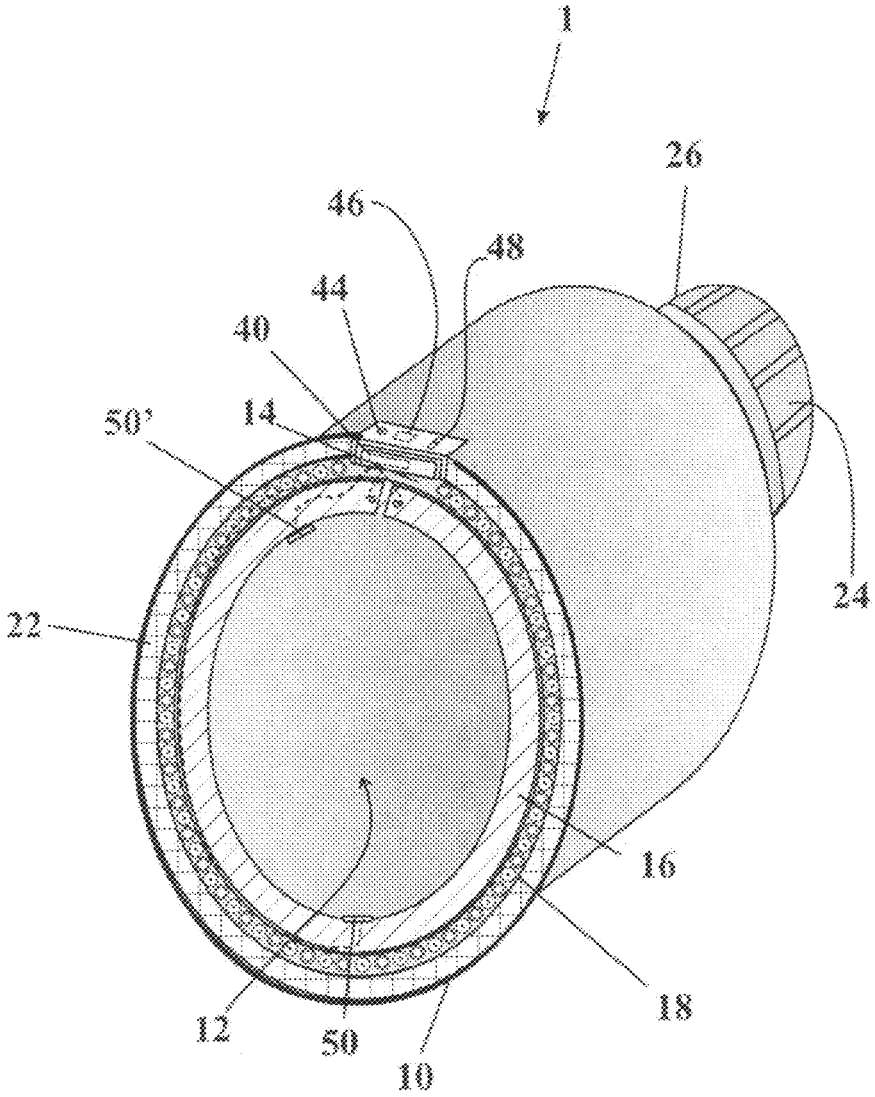
FIG. 5 is a cross sectional view of an alternate embodiment of the submersible hand warmer, wherein there is a multifunctional housing that provides a compartment for the energy source and structural support for the submersible hand warmer, where the multifunctional housing can accommodate a plurality of batteries.

FIG. 5 is a cross sectional view of an alternate embodiment of the submersible hand warmer, wherein the submersible hand warmer has a multifunctional housing 14 that provides a compartment for the energy source and structural support for the housing. In the figure a plurality of batteries are arranged circumferentially in the multifunctional housing 14, therein providing both strength and conservational utilization of the available space. The multifunctional housing can be thought of as being analogous to a helicopter body or multiply cardboard. The separation of plies adds strength, reduces weight, and creates a space for the batteries. In the illustrated embodiment there are two thermal sensors, a bottom sensor 50 and a top sensor 50'. More sensors or a circumferential sensor could be employed to ensure contact with the heat transfer fluid.

Figure 6:
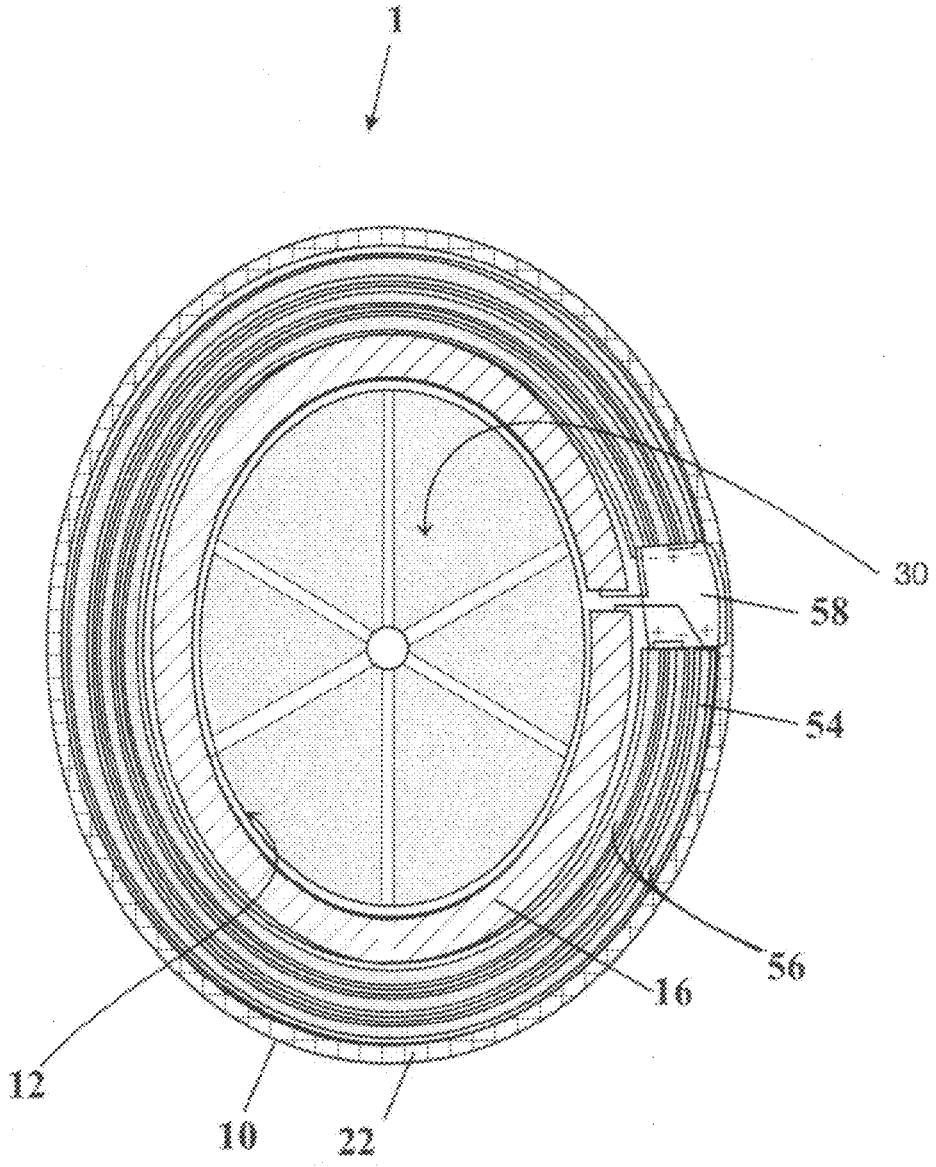
FIG. 6 is a cross sectional end-on view of an alternate embodiment of the submersible hand warmer, wherein a plurality of flexible batteries, such as filmic polymeric batteries, are fused/adhered into a laminate element that functions as the housing and the energy source.

FIG. 6 is a cross sectional end-on view of an alternate embodiment of the submersible hand warmer 1, wherein a plurality of flexible batteries, such as filmic polymeric batteries 54, are laminated into a laminate 56 that combines the housing and the energy source having a desired shape (i.e. elliptical). The laminate functions as the housing (structural support), as well as the energy source. The filmic polymeric batteries 54 are wired in series through junction box 58. The housing and energy source laminate 56 can provide sufficient energy to the heating component to heat the heat transfer fluid to at least 54° F. in a matter of minutes. The filmic polymeric batteries 54 utilize a lithium ion polymer (Li-ion polymer)—a potentially lower cost version of the Li-ion batteries or an organic radical battery (ORB)—a new battery technology being developed by NEC. These polymeric batteries can be recharged very fast. The battery is typically pre-laminated on layers of film, and these pre-laminates are combined into contoured shapes—like the elliptical chamber 12. The batteries are similar to Li-ion batteries in terms of energy density. As can be seen in FIG. 6, the right access port 24 is covered with a right flap 30 that restricts the flow of cold ambient water into the chamber through the right sleeve portion 26. The right flap 30 obscures the view of right sleeve portion 26 in the figure. Similarly, the left access port is covered with a left flap that restricts the flow of cold ambient water into the chamber through the left sleeve portion. The flaps have a plurality of sections, six are shown, so that when the diver pushes his gloved hand into the chamber, the sections fold back. The flaps are typically made of some rubbery material, possibly similar to the sleeve. In the illustrated embodiment the center sleeve portion 10 is lined with insulation 22.

Figure 7:
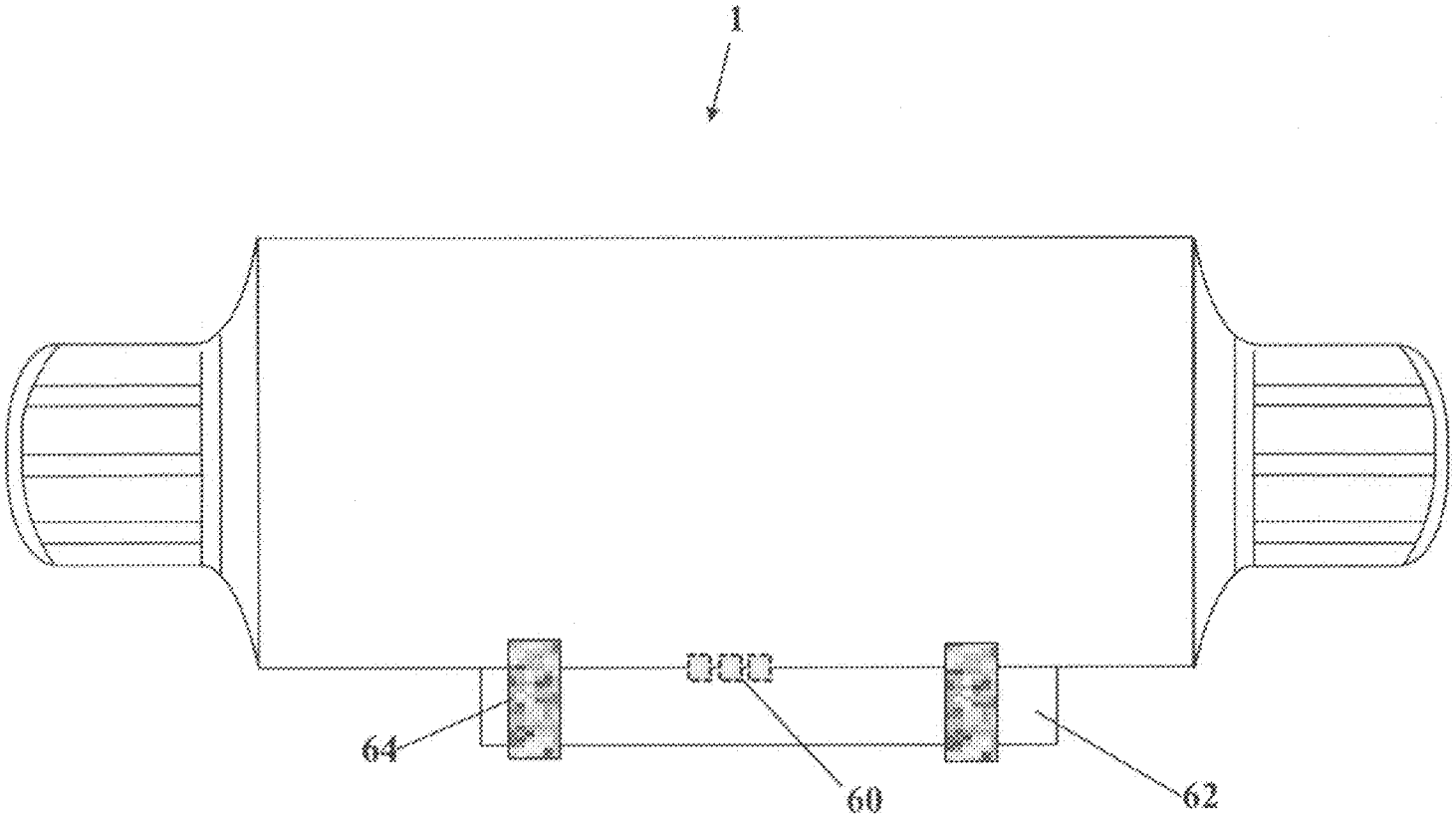
FIG. 7 is a frontal side view of the submersible hand warmer illustrated in FIG. 2 fitted with an auxiliary energy source, such as a battery pack, that can be added or swapped-out underwater.

FIG. 7 is a frontal side view of the submersible hand warmer 1 illustrated in FIG. 2. As can be seen in this embodiment, the submersible hand warmer 1 can be fitted with an auxiliary energy source. The auxiliary energy source is an auxiliary battery pack 62, which is plugged into an auxiliary battery connection 60. The auxiliary battery pack 62 is fastened to the submersible hand warmer with fastening elements, such as hook and loop fastening elements 64.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

It is to be understood that the foregoing description and specific embodiments are merely illustrative of the best mode of the invention and the principles thereof, and that various modifications and additions may be made to the invention by those skilled in the art, without departing from the spirit and scope of this invention, which is therefore understood to be limited only by the scope of the appended claims.

What is claimed is:

1. A submersible hand warmer apparatus, said apparatus comprising:

a sleeve having a center sleeve portion with an elongate chamber having a right access port and a left access port, said chamber sized to accommodate an effective amount of a heat transfer fluid, where an effective amount is the amount that raises the temperature of the diver's hands to at least 54° F. (12° C.) upon immersion of his hands in the heat transfer fluid; said sleeve also having a right sleeve portion extending from the right access port with a right elastic cuff; and a left sleeve portion extending from the left access port with a left elastic cuff, where the right elastic cuff and the left elastic cuff stretch allowing the diver's gloved hands access to the chamber, and then the cuffs retract, forming at least a partial seal against a diver's right arm and left arm;

a heating component which is in contact with the heat transfer fluid and warms the heat transfer fluid to at least 54° F.;

an energy source that can provide sufficient energy to the heating component to heat the heat transfer fluid to at least 54° F.;

a housing which provides structural support for the apparatus;

an insulation that slows the loss of heat to cold ambient water; and a controller that controls a rate of energy received by the heating component, and therein the temperature of the heat transfer fluid.

2. The apparatus according to claim 1, wherein said heat transfer fluid is substantially water.

3. The apparatus according to claim 2, wherein said effective amount of water for an adult diver is about one liter plus or minus about one half of a liter.

4. The apparatus according to claim 1 wherein said chamber is substantially elliptical in circumference having a long diameter and a short diameter, where the long diameter is longer than a width of the gloved hand and the short diameter is longer than a thickness of the gloved hand.

5. The apparatus according to claim 4 wherein said chamber has a length that is long enough to accommodate a pair of gloved hands.

6. The apparatus according to claim 1, wherein said heating component is a rubbery heating pad.

7. The apparatus according to claim 6, wherein said rubbery heating pad is comprised of silicone rubber.

8. The apparatus according to claim 1 further comprising a temperature sensor that measures the temperature of the heat transfer fluid, therein providing feedback to the controller.

9. The apparatus according to claim 8, wherein said controller is a feedback controller selected from the group consisting of an On/Off Controller (controller switches On/Off only when the temperature of the heat transfer fluid as measured by said temperature sensor crosses a setpoint), a Proportional Controller (controller decreases the average power supplied to the heater as the temperature of the heat transfer fluid approaches the setpoint), a PID controller (provides proportional with integral and derivative control—sometimes referred to as autotune controllers), and other feedback controllers.

10. The apparatus according to claim 1, wherein said energy source is a battery.

11. The apparatus according to claim 10, wherein said battery is rechargeable.

12. The apparatus according to claim 11 further comprising an electrical jack for connecting the apparatus to an external energy source and recharging the battery.

13. The apparatus according to claim 1, wherein said controller has a setpoint, where said setpoint is nominally between a range of 54° F. (12° C.) and 100° F. (38° C.).

14. The apparatus according to claim 1, wherein said controller has an illuminated display that provides a calculated estimate of a remaining operational percentage of energy or time based on a rate that energy is being consumed.

15. The apparatus according to claim 1 further comprising an auxiliary energy source that can be added to the apparatus while the apparatus is in or out of the water.

16. The apparatus according to claim 1, wherein said housing is comprised of a thermoplastic polymer.

17. The apparatus according to claim 1 further comprising a right flap covering the right access port and a left flap covering the left access port.

18. A submersible hand warmer apparatus, said apparatus comprising:

a sleeve having a center sleeve portion with an elongate chamber having a right access port and a left access port, said chamber sized to accommodate an effective amount of warming water, which functions as a heat transfer fluid, where an effective amount is the amount that raises the temperature of the diver's hands to at least 54° F. (12° C.) upon immersion of his hands in the warming water; said sleeve also having a right sleeve portion extending from the right access port with a right elastic cuff; and a left sleeve portion extending from the left access port with a left elastic cuff, where the right elastic cuff and the left elastic cuff can stretch allowing the diver's gloved hands access to the chamber, and then retract, forming at least a partial seal against a diver's right arm and left arm;

a heating component which is in contact with the warming water to at least 54° F.;

an energy source that can provide sufficient energy to the heating component to heat the warming water to at least 54° F.;

a multifunctional housing disposed circumferentially around the sleeve that provides a compartment for the energy source and structural support for the apparatus;

an insulation that slows the loss of heat to cold ambient water; and a controller that controls a rate of energy received by the heating component, and therein the temperature of the warming water.

19. The apparatus according to claim 18, wherein said energy source is a plurality of batteries arranged circumferentially in the multifunctional housing.

20. A submersible hand warmer apparatus, said apparatus comprising:

a sleeve having a center sleeve portion with an elongate chamber having a right access port and a left access port, said chamber sized to accommodate an effective amount of a heat transfer fluid, where an effective amount is the amount that raises the temperature of the diver's hands to at least 54° F. (12° C.) upon immersion of his hands in the heat transfer fluid; said sleeve also having a right sleeve portion extending from the right access port with a right elastic cuff; and a left sleeve portion extending from the left access port with a left elastic cuff, where the right elastic cuff and the left elastic cuff can stretch allowing the diver's gloved hands access to the chamber, and then retract, forming at least a partial seal against a diver's right arm and left arm;

a heating component which is in contact with the heat transfer fluid and warms the heat transfer fluid to at least 54° F.;

a laminate that can provide sufficient energy to the heating component to heat the heat transfer fluid to at least 54° F., where said laminate is a plurality of flexible polymeric batteries fused/adhered together forming a structural support for the apparatus;

an insulation that slows the loss of heat to cold ambient water; and a controller that controls a rate of energy used by the heating component, and therein the temperature of the heat transfer fluid.

* * * * *